US006720849B2

(12) United States Patent
Sasaki et al.

(10) Patent No.: US 6,720,849 B2
(45) Date of Patent: Apr. 13, 2004

(54) HIGH FREQUENCY FILTER, FILTER DEVICE, AND ELECTRONIC APPARATUS INCORPORATING THE SAME

(75) Inventors: Yutaka Sasaki, Yokohama (JP); Akihide Nakano, Kanazawa (JP); Tatsuya Tsujiguchi, Kanazawa (JP); Hiroaki Tanaka, Osaka-fu (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 10/001,672

(22) Filed: Oct. 31, 2001

(65) Prior Publication Data

US 2002/0057143 A1 May 16, 2002

(30) Foreign Application Priority Data

Nov. 14, 2000 (JP) ..... 2000-346534

(51) Int. Cl.[7] ..... H01P 1/203
(52) U.S. Cl. ..... 333/204; 333/219
(58) Field of Search ..... 333/204, 219, 333/235, 26

(56) References Cited

U.S. PATENT DOCUMENTS 4,563,773 A * 1/1986 Dixon, Jr. et al. ..... 455/327
5,066,933 A * 11/1991 Komeda ..... 333/204

FOREIGN PATENT DOCUMENTS

| | | |
|---|---|---|
| EP | 0 660433 | 12/1994 |
| JP | 5-199010 | 8/1993 |
| JP | 7-86802 | 3/1995 |
| JP | 0786802 | 3/1995 |
| JP | 11-220304 | 8/1999 |
| SU | 1541-690 | 2/1990 |

OTHER PUBLICATIONS

Article IEEE MTT–S, Murat Manufacturing Co., Ltd., "Multi–chip Transmitter/Receiver Module Using High Dielectric Substrates for 5.8 Ghz ITS Applications" May 1999.

* cited by examiner

*Primary Examiner*—Robert Pascal
*Assistant Examiner*—Stephen E. Jones
(74) *Attorney, Agent, or Firm*—Dickstein, Shapiro, Morin & Oshinsky, LLP.

(57) ABSTRACT

The invention provides a high frequency filter which can facilitate filter-characteristic adjustments and miniaturization and can obtain an excellent broadband characteristic. In addition, the invention provides a filter device using the high frequency filter, and an electronic apparatus incorporating the same. In this filter, a ground electrode is arranged on one of the main surfaces of a dielectric substrate. On the other main surface thereof there are arranged two or more microstrip lines, and one end of each microstrip line is grounded via a through-hole to form a high frequency filter. The microstrip lines and the shared through-hole constitute microstrip line resonators, which are coupled via the inductance of the through-hole. With this arrangement, there is no need for an additional coupling element. Thus, the size of the high frequency filter can be reduced. Furthermore, since a large coupling coefficient can be obtained, the high frequency filter can have a broadband characteristic.

17 Claims, 7 Drawing Sheets

HIGH FREQUENCY FILTER, FILTER DEVICE, AND ELECTRONIC APPARATUS INCORPORATING THE SAME

BACKGROUND OF THE INVENTION

1. Field of the Invention

The present invention relates to high frequency filters and filter devices using the filters. The invention also relates to electronic apparatuses incorporating the same.

2. Description of the Related Art

Conventionally, in a high frequency filter, a ground electrode is arranged on one of the main surfaces of a dielectric substrate and microstrip lines are formed on the other main surface of the substrate to form a plurality of resonators. In order to ground parts of the microstrip lines on the other main surface of the dielectric substrate, a through-hole is often used to connect the microstrip lines to the ground electrode.

There is also known another type of high frequency filter using a through-hole as a resonator or a part of the resonator. For example, Japanese Unexamined Patent Application Publication No. 7-86802 describes a high frequency filter using through-holes as resonators. This high frequency filter includes resonators formed by using the inductance and the capacitance of the through-holes. The plurality of resonators are electrically coupled to each other via a capacitance at the gap between electrodes formed on one of the main surfaces of a dielectric substrate to constitute the high frequency filter.

On the other hand, the high frequency filter using the through-holes as resonators has a problem in that it is difficult to adjust the characteristics of the resonators. In other words, when adjusting the characteristics, the diameters of the through-holes need to be changed. However, in order to do so, for example, the dielectric substrate must be replaced, which takes time and increases cost. In addition, since it is difficult to make fine adjustments of the diameters of the through-holes, accurate adjustments are unlikely to be expected.

Furthermore, since the inter-electrode gap, which serves as an additional capacitance element, is used to couple the resonators, the size of the filter increases.

In addition, it is impossible to make the coupling coefficient large by using electrical coupling obtained via the capacitance of the inter-electrode gap. As a result, the high frequency filter cannot obtain a broadband characteristic.

SUMMARY OF THE INVENTION

The present invention is able to provide a high frequency filter which facilitates filter-characteristic adjustments and achieves miniaturization. Furthermore, by increasing the inter-resonator coupling coefficient, a broadband characteristic is obtainable. The invention is further able to provide a filter device using the high frequency filter and an electronic apparatus incorporating the same.

To this end, according to a first aspect of the invention, there is provided a high frequency filter including a dielectric substrate, a ground electrode arranged on a main surface of the dielectric substrate, a through-hole, and a plurality of microstrip line resonators formed on the other main surface of the dielectric substrate, a first end of each resonator being grounded via the through-hole. In this filter, the microstrip line resonators share the through-hole for grounding the first end of each resonator, and the resonators are mutually coupled via the inductance of the through-hole.

According to a second aspect of the invention, there is provided a high frequency filter including a dielectric substrate, a ground electrode arranged on a main surface of the dielectric substrate, a through-hole, and two microstrip line resonators formed on the other main surface of the dielectric substrate, a first end of each resonator being grounded via the through-hole. In this filter, the two microstrip line resonators share the through-hole for grounding the first end of each resonator, and the resonators are mutually coupled via the inductance of the through-hole.

In addition, in this filter, the two microstrip line resonators may be spirally formed by being wound in mutually opposite directions.

In addition, a side edge of one of the two microstrip line resonators may be arranged near a side edge of the other microstrip line resonator to mutually couple the resonators inductively.

In addition, in this filter, a second end of one of the two microstrip line resonators may be opposed to the side edge of the other microstrip line resonator to mutually couple the resonators capacitively.

The high frequency filter according to one of the first and second aspects may further include input/output electrodes or wires, each being connected to a point disposed between the first end and the second end of a respective microstrip line resonator.

According to a third aspect of the invention, there is provided a filter device including the high frequency filter according to one of the first and second aspects of the invention.

According to a fourth aspect of the invention, there is provided an electronic apparatus including the high frequency filter according to one of the first and second aspects or the above filter device.

With the arrangements described above, in the high frequency filter and the filter device of the present invention, the filter characteristics can be easily adjusted and miniaturization can be achieved. Moreover, by making the coupling coefficient for coupling between the resonators larger, a broadband characteristic can be obtained.

Furthermore, in the electronic apparatus of the invention, miniaturization, cost reduction, and the improvement of performance capabilities can be achieved.

Other features and advantages of the invention will be understood from the following description of embodiments thereof, with reference to the drawings, in which like references indicate like elements and parts.

DESCRIPTION OF EMBODIMENTS OF THE INVENTION

Figure 1:
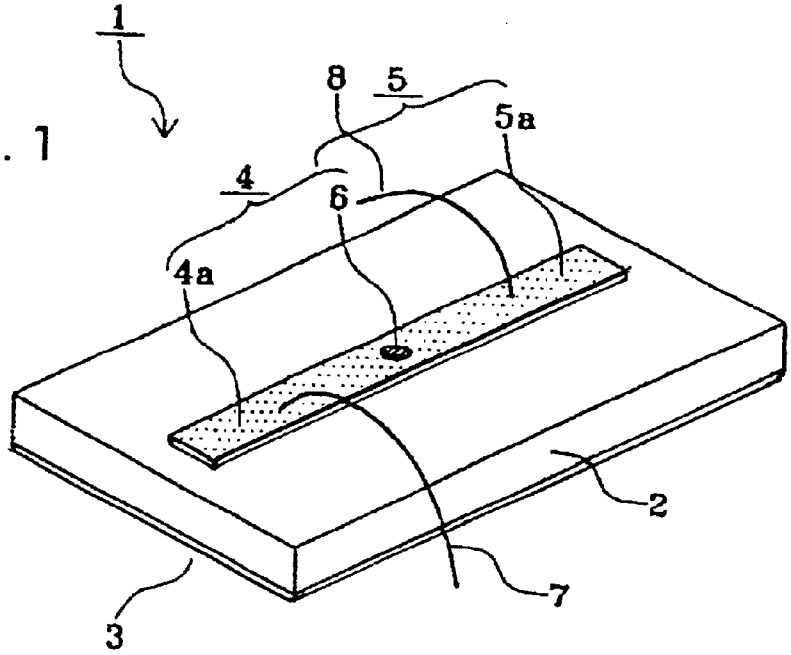
FIG. 1 is a perspective view of a high frequency filter according to an embodiment of the present invention.

FIG. 1 shows a perspective view of a high frequency filter according to an embodiment of the present invention. In FIG. 1, a high frequency filter 1 includes a dielectric substrate 2, a ground electrode 3 arranged substantially on an entire main surface of the dielectric substrate 2, two microstrip lines 4*a* and 5*a* arranged on the other main surface of the dielectric substrate 2, a through-hole 6 formed at the junction of the two microstrip lines 4*a* and 5*a*, and signal output/input wires 7 and 8 connected to the two microstrip lines 4*a* and 5*a*. Each of the wires 7 and 8 is also connected to an outside circuit, which is not shown here.

In the high frequency filter 1, the microstrip line 4*a* and the through-hole 6 constitute a ¼-wavelength microstrip line resonator 4 with one end grounded and the other end open-circuited. Similarly, the microstrip line 5*a* and the through-hole 6 constitute a ¼-wavelength microstrip line resonator 5 with one end grounded and the other end open-circuited. In other words, the microstrip line resonators 4 and 5 share the through-hole 6.

Figure 2:
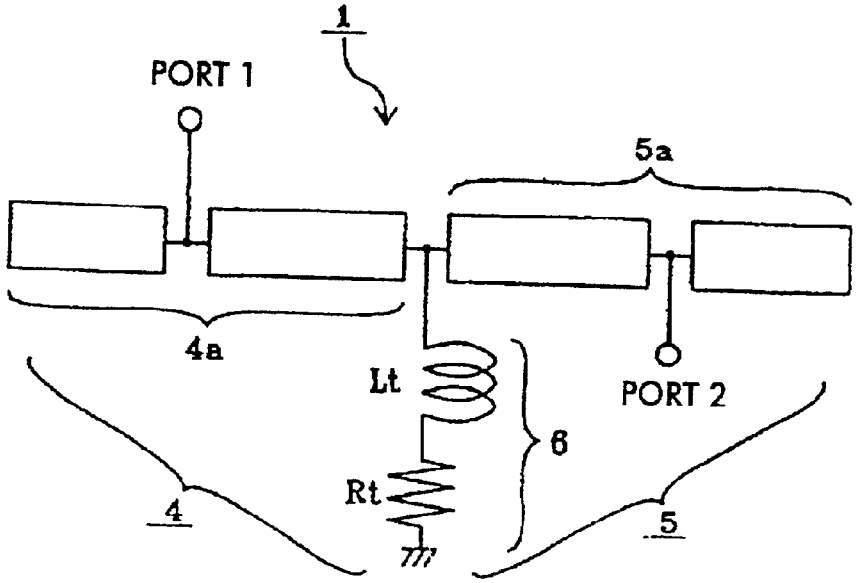
FIG. 2 is an equivalent circuit diagram of the high frequency filter shown in FIG. 1.

FIG. 2 shows an equivalent circuit diagram of the high frequency filter 1. As shown in FIG. 2, in the high frequency filter 1, the two microstrip lines 4*a* and 5*a* are connected to each other, and the junction of the lines 4*a* and 5*a* is grounded via a series circuit composed of an inductor Lt and a resistor Rt as equivalent-circuit elements of the through-hole 6. In addition, the microstrip line resonator 4 formed by the microstrip line 4*a* and the through-hole 6 is coupled to the microstrip line resonator 5 formed by the microstrip line 5*a* and the through-hole 6 via the inductor Lt as the inductance of the through-hole 6. In this figure, a port 1 represents the wire 7 and a port 2 represents the wire 8.

This circuit generates an odd-mode resonant frequency (fodd) determined by the lengths of the microstrip lines 4*a* and 5*a* and an even-mode resonant frequency (feven) including the inductor Lt of the through-hole 6. By changing the value of the Lt according to a required bandwidth, the amount (k) of coupling between the two microstrip line resonators 4 and 5 can be adjusted.

The wires 7 and 8 are used to couple the high frequency filter 1 to outside circuits. Thus, the external Q (Qe) of the high frequency filter 1 can be varied by changing the positions where the wires 7 and 8 are connected to the two microstrip lines 4*a* and 5*a*. In other words, the external Q can be adjusted by adjusting the positions for connecting the wires.

In the high frequency filter 1 having the above structure, the two microstrip line resonators 4 and 5 are magnetically coupled to each other via the inductance Lt of the through-hole 6. Thus, since no extra element used only for coupling the resonators 4 and 5 is necessary, the high frequency filter 1 can be made compact. In addition, in the case of magnetic coupling obtained by the inductance Lt of the through-hole 6, as compared with the case of electrical coupling obtained by a capacitive element such as the gap between electrodes in conventional filters, a larger coupling coefficient can be obtained. As a result, the high frequency filter 1 can easily be given a broadband characteristic.

Figure 3:
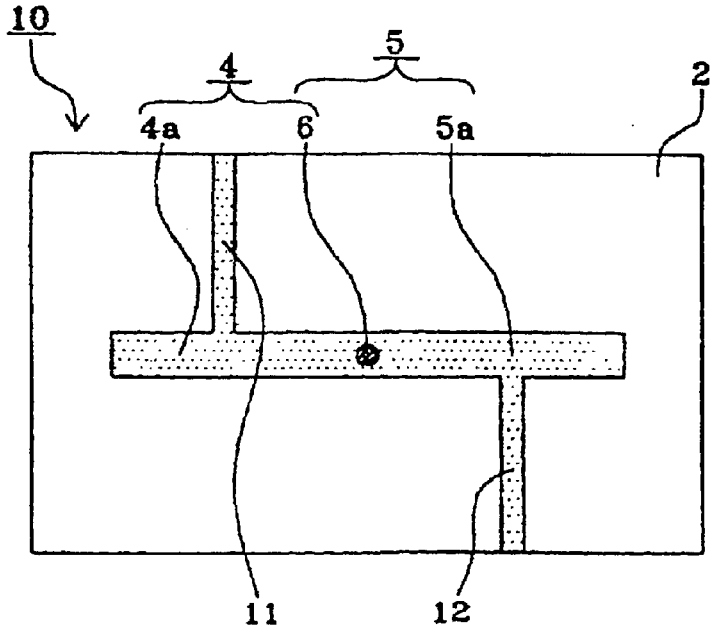
FIG. 3 is a plan view of a high frequency filter according to another embodiment of the present invention.

For coupling the filter to an outside circuit, the wire coupling as mentioned above is not the only method that can be used. FIG. 3 shows a plan view of a high frequency filter according to another embodiment of the invention. Here, the reference numerals used in the high frequency filter shown in FIG. 1 are given to the same and equivalent parts of the filter shown in FIG. 3, and the explanation of the parts will not be given. Like a high frequency filter 10 shown in FIG. 3, in FIG. 1, at the positions for connecting the wires 7 and 8 to the two microstrip lines 4*a* and 5*a*, there may be arranged taps 11 and 12 made of narrower microstrip lines to connect to outside circuits. With this method of connection with the outside circuit, an external Q is fixed as compared with when using the wires 7 and 8. However, there can be obtained substantially the same advantages as those obtained in the high frequency filter 1 using the wires 7 and 8.

Figure 4:
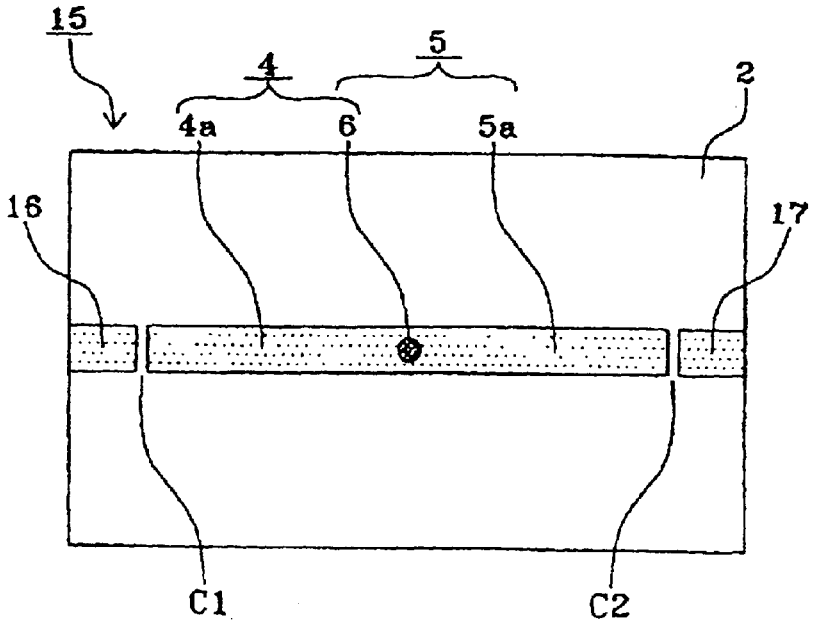
FIG. 4 is a plan view of a high frequency filter according to another embodiment of the present invention.

Additionally, such coupling to an outside circuit may be made by other methods. FIG. 4 shows a plan view of a high frequency filter according to another embodiment of the invention. Here, the reference numerals used in the high frequency filter 1 shown in FIG. 1 are given to the same and equivalent parts in the filter shown in FIG. 4, and no explanation of the parts will be provided. As in a high frequency filter 15 shown in FIG. 4, near the open-circuited ends of two microstrip lines 4*a* and 5*a*, there may be arranged input/output electrodes 16 and 17. In this case, the input/output electrodes 16 and 17 are connected to outside circuits. The high frequency filter 15 and the outside circuits are coupled via capacitances C1 and C2 generated between the input/output electrodes 16, 17, and the microstrip lines 4*a* and 5*a*. Adjustments can be made to external Q by adjusting the capacitances C1 and C2. Thus, this embodiment can also provide substantially the same advantages as those obtained in the high frequency filter 1 using the wires 7 and 8.

Figure 5:
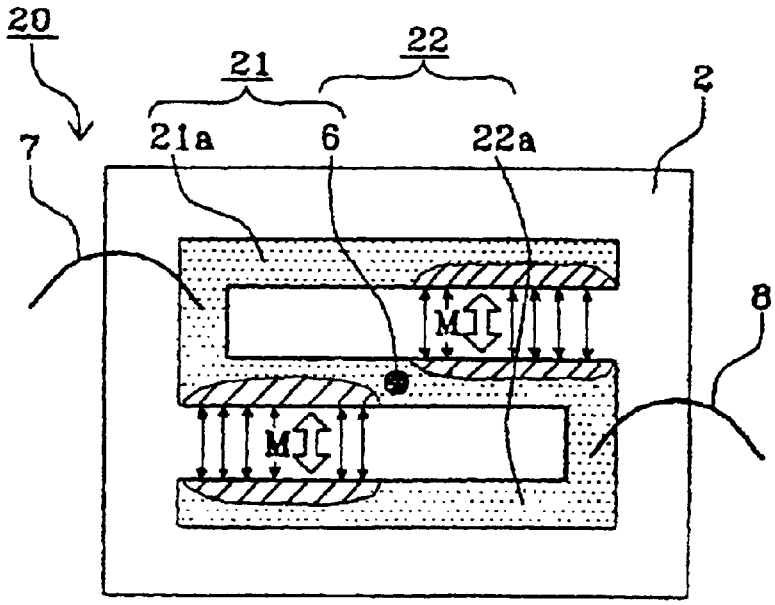
FIG. 5 is a plan view of a high frequency filter according to another embodiment of the present invention.

FIG. 5 shows a plan view of a high frequency filter according to another embodiment of the invention. In FIG. 5, the reference numerals used in FIG. 1 are given to the same and equivalent parts of the filter and the explanation of the parts will be omitted.

In FIG. 5, there is shown a high frequency filter 20 including two microstrip lines 21*a* and 22*a* arranged on a main surface of a dielectric substrate 2, a through-hole 6 formed at the junction of the microstrip lines 21*a* and 22*a*, and signal input/output wires 7 and 8 connected to the microstrip lines 21*a* and 22*a*.

In the high frequency filter 20, the microstrip line 21*a* and the through-hole 6 constitute a ¼-wavelength microstrip line resonator 21 with a first end grounded and the second end open-circuited. In addition, the microstrip line 22*a* and the through-hole 6 constitute a ¼-wavelength microstrip line resonator 22 with a first end grounded and the second end open-circuited. In other words, the microstrip line resonators 21 and 22 share the through-hole 6.

In this case, the microstrip lines 21*a* and 22*a* are spirally formed by being wound in mutually opposite directions to make an overall S-shaped configuration.

By spirally forming the microstrip lines 21*a* and 22*a*, the dimensions of the dielectric substrate 2 constituting the high frequency filter 20 are reduced. Thus, the high frequency filter can be miniaturized.

The second end of the microstrip line 21*a* is arranged near a side edge of the microstrip line 22*a*, near the first end of the microstrip line 22*a*. In addition, the second end of the microstrip line 22*a* is arranged near a side edge of the microstrip line 21 a, near the first end of the microstrip line 21*a*. By the arrangement, magnetic couplings M are generated at the parts where side edges around the open-circuited ends of the microstrip lines 21*a* and 22*a* are arranged near the side edges around the grounded ends of the microstrip lines 22*a* and 21*a*, respectively. In other words, the microstrip line resonators 21 and 22 are coupled not only via the inductance of the through-hole 6 but also by the magnetic couplings M between the microstrip lines 21*a* and 22*a*. The magnetic couplings M can compensate for an insufficiency of the coupling provided by the inductance of the through-hole 6. For example, if the dielectric substrate 2 is not thick enough to allow the microstrip line resonators 21 and 22 to be coupled via the inductance of the through-hole 6, the magnetic couplings M between the microstrip lines 21*a* and 22*a* can compensate for the insufficiency of the coupling provided by the through-hole. Furthermore, by adjusting the gaps between the mutually adjacent parts of the strip lines 21*a* and 22*a*, the magnitudes of the magnetic couplings M can be controlled, thereby increasing the freedom of design of the high frequency filter 20.

Figure 6:
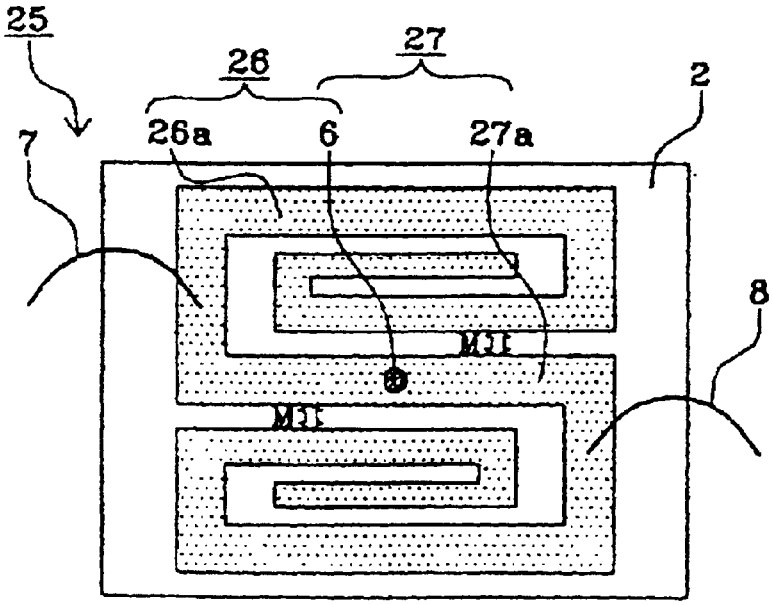
FIG. 6 is a plan view of a high frequency filter according to another embodiment of the present invention.

The configuration of the microstrip lines does not have to be necessarily S-shaped. FIG. 6 shows a plan view of a high frequency filter according to another embodiment of the invention. In FIG. 6, the reference numerals used in FIG. 1 are given to the same and equivalent parts and the explanation of the parts will be omitted.

In FIG. 6, each of microstrip lines 26*a* and 27*a* of a high frequency filter 25 has a length such that it forms a spiral shape of approximately 1.5 turn. The microstrip line 26*a* and a through-hole 6 constitute a ¼-wavelength microstrip line resonator 26 with one end grounded and the other end open-circuited. Additionally, the microstrip line 27*a* and the through-hole 6 constitute a ¼-wavelength microstrip line resonator 27 with one end grounded and the other end open-circuited. In other words, the microstrip line resonators 26 and 27 share the through-hole 6.

A part of the microstrip line 26*a* is adjacent to a side edge near the first end of the microstrip line 27*a*. In addition, a part of the microstrip line 27*a* is adjacent to a side edge near the first end of the microstrip line 26*a*.

In the high frequency filter 25 having the above structure, also, since magnetic couplings M are generated between the microstrip lines 26*a* and 27*a*, the same advantages as those obtained in the high frequency filter 20 can be obtained. Additionally, since the lengths of the microstrip lines 26*a* and 27*a* can be increased, the high frequency filter 25 can be made smaller than the high frequency filter 20.

Furthermore, the high frequency filter 25 adopts a step-impedance configuration, in which the closer to the second ends (the open-circuited ends) of the microstrip lines 26*a* and 27*a*, the narrower the line widths. In the case of a ¼-wavelength resonator, resonance is produced even at a frequency three times as high as a fundamental resonant frequency. However, when using the step-impedance configuration, inductances at the second ends of the microstrip line resonators increase. As a result, the frequency of the resonator becomes lower than three times as high as the resonant frequency. Thus, the high frequency filter 25 has an advantage in which attenuation characteristics obtained at the frequency three times as high as the resonant frequency can be improved.

Figure 7:
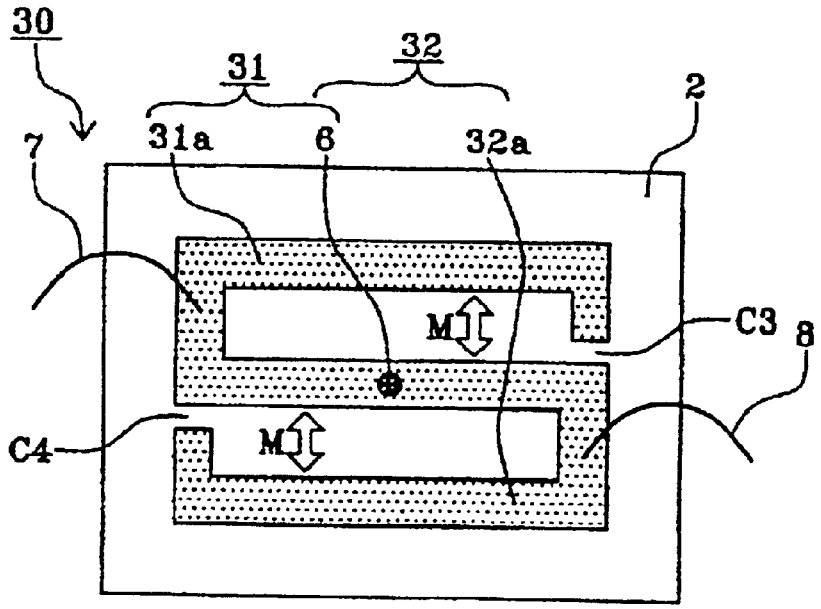
FIG. 7 is a plan view of a high frequency filter according to another embodiment of the present invention.

FIG. 7 shows a plan view of a high frequency filter according to another embodiment of the invention. In FIG. 7, the reference numerals used in FIG. 5 are given to the same and equivalent parts and the explanation of the parts will be omitted.

In FIG. 7, a high frequency filter 30 includes microstrip lines 31*a* and 32*a* formed on one of the main surfaces of a dielectric substrate 2, a through-hole 6 formed at the junction of the microstrip lines 31*a* and 32*a*, and signal input/output wires 7 and 8 connected to the microstrip lines 31*a* and 32*a*.

In the high frequency filter 30, the microstrip line 31*a* and the through-hole 6 constitute a ¼-wavelength microstrip line resonator 31 with a first end grounded and the second end open-circuited. In addition, the microstrip line 32*a* and the through-hole 6 constitute a ¼-wavelength microstrip line resonator 32 with a first end grounded and the second end open-circuited. In other words, the microstrip line resonators 31 and 32 share the through-hole 6.

In this situation, the microstrip lines 31 a and 32*a* are spirally formed by being wound in mutually opposite directions to make an overall S-shaped configuration. The second end of the microstrip line 31*a* is arranged near a side edge near the first end of the microstrip line 32*a*. The second end of the microstrip line 32*a* is also arranged near a side edge near the first end of the microstrip line 31*a*.

In addition, the second end of the microstrip line 31*a* is arranged near the side edge of the microstrip line 32*a* in a mutually opposing manner. The second end of the microstrip line 32*a* is arranged near the side edge of the microstrip line 31*a* in a mutually opposing manner. With this arrangement, coupling capacitances C3 and C4 are generated at the opposing parts to provide electrical couplings. The electrical couplings perform a function of canceling the magnetic couplings M between the microstrip lines 31*a* and 32*a*.

For example, in the high frequency filter 20 shown in FIG. 5, due to miniaturization, when the microstrip lines 21*a* and 22*a* are arranged so close to each other that the couplings M between the microstrip lines become too strong, it is necessary to widen the gap between the microstrip lines 21*a* and 22*a* even if this prevents miniaturization from being achieved. However, in the high frequency filter 30 shown in FIG. 7, when the microstrip lines 31*a* and 32*a* are so close to each other that the couplings M between the microstrip lines are too strong, the couplings can be adjusted without increasing the gaps between the microstrip lines 31*a* and 32*a*, by narrowing the gaps between the parts where the open-circuited ends of the microstrip lines 31*a* and 32*a* are opposed to the side edges of the microstrip lines 32*a* and 31*a* to increase the coupling capacitances C3 and C4. As a result, the high frequency filter 30 can be made smaller than the high frequency filter 20.

Figure 8:
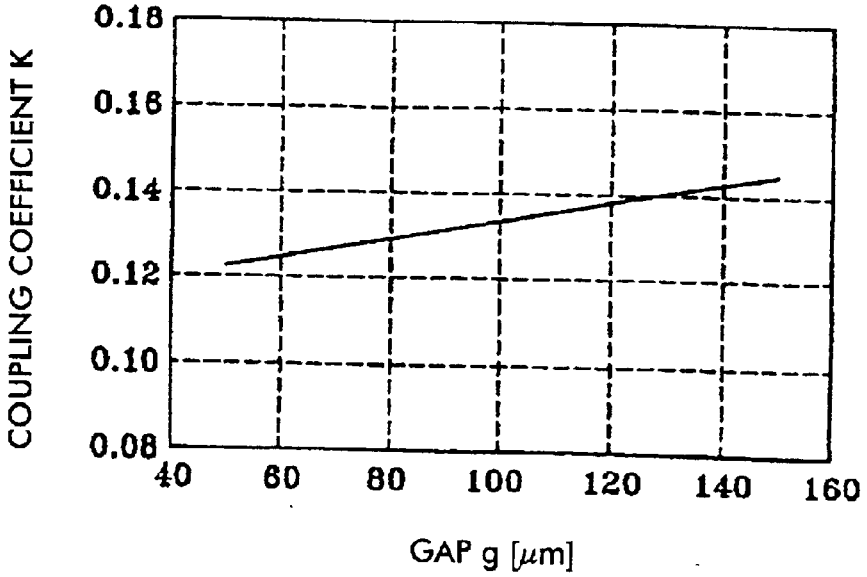
FIG. 8 is a characteristic chart showing a correlation between the length of the gap between the open-circuited end of a microstrip line and a side edge of the other microstrip line and the coupling coefficient of the two microstrip line resonators in the high frequency filter shown in FIG. 7.

FIG. 8 shows experimental results regarding a correlation between the gap g between the part where the open-circuited end of one of the microstrip lines is opposed to the side edge of the other microstrip line, and the coupling coefficient k which defines the coupling between the microstrip line resonators 31 and 32 in the high frequency filter 30. As shown in FIG. 8, obviously, as the gap g becomes narrower, the coupling coefficient k becomes smaller. In the high frequency filter 30 used in this experiment, it is shown that the coupling coefficient k obtained only via the inductance Lt of the through-hole 6 is 0.122. In fact, when magnetic couplings M are added, the coupling coefficient k becomes larger than 0.122. Then, in FIG. 8, by reducing the gap g to 50 mm, the magnetic couplings and the electrical couplings cancel each other and thereby the coupling coefficient k coincides with a coupling coefficient obtained only by the inductance Lt of the through-hole 6. The relative permittivity of a dielectric substrate used in this experiment is 110. The substrate is 0.3 mm thick and the diameter of the through-hole is 145 mm long. The gaps between the parts where the two microstrip lines are arranged near each other are set to be 150 mm.

Figure 9:
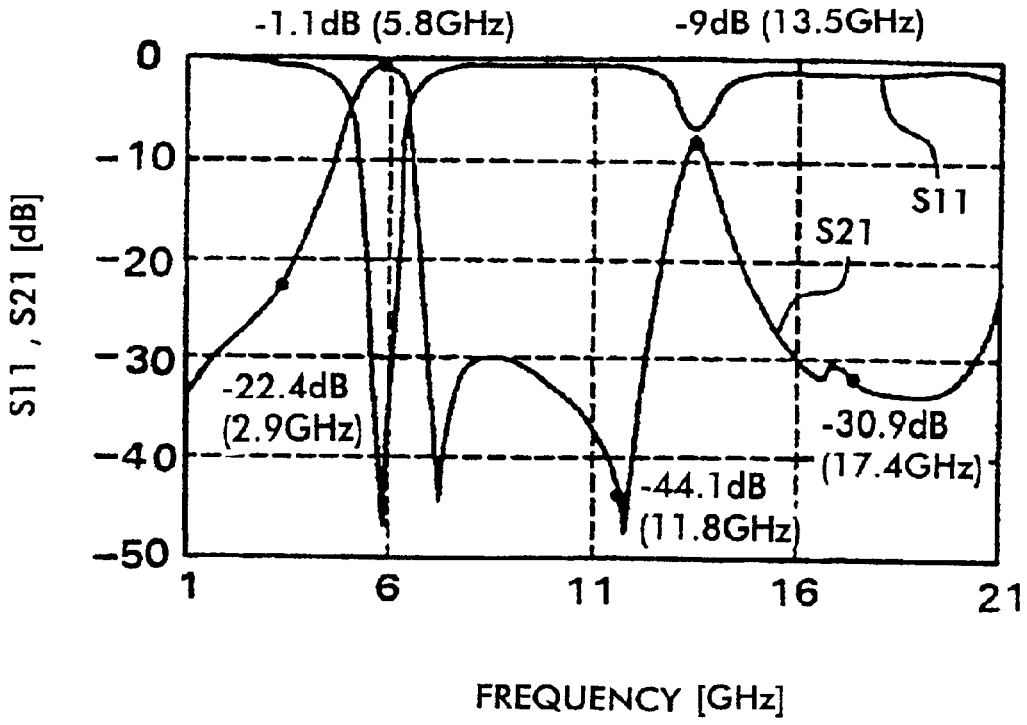
FIG. 9 is a characteristic chart showing the frequency characteristics of the high frequency filter shown in FIG. 7.

FIG. 9 illustrates frequency characteristics S11 (reflection loss) and S21 (insertion loss) obtained when the high frequency filter 30 is actually produced as a band pass filter. In FIG. 9, as shown by black dots, there were obtained characteristics in which the central frequency of the pass band is 5.8 GHz, a 3-dB bandwidth of the pass band is 980 MHz, and insertion loss of the pass-band is −1.1 dB at 5.8 GHz. In addition, there were obtained characteristics such as −22.4 dB at 2.9 GHz as an attenuation band, −44.1 GHz at 11.6 GHz, and −30.9 dB at 17.4 GHz. In this case, the frequency 17.4 GHz is equivalent to a frequency approximately three times as high as the central frequency 5.8 GHz. Like the high frequency filter 25 shown in FIG. 6, the high frequency filter 30 adopts the step-impedance structure in which the open-circuited ends of the microstrip line resonators 31 and 32 have narrower widths. With this arrangement, the frequency, which should primarily be three times as high as the fundamental resonant frequency, is shifted to near the frequency of approximately 13.5 GHz lower than that. As a result, attenuation characteristic obtained at 17.4 GHz is −30.9 dB, which is an excellent value.

Figure 10:
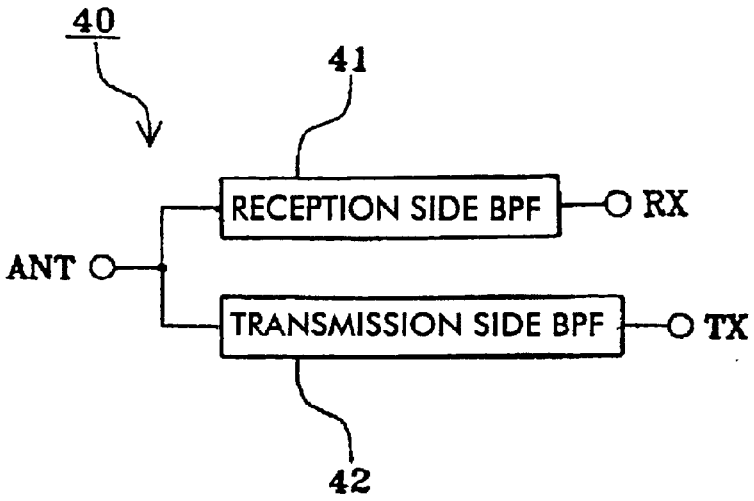
FIG. 10 is a block diagram of a filter device according to an embodiment of the present invention.

FIG. 10 shows a block diagram of a duplexer, which is an example of a filter device according to an embodiment of the invention. In a duplexer 40 shown in FIG. 10, one end of a reception filter BPF 41 and one end of a transmission filter BPF 42, in which the filters have mutually different pass bands, are connected to each other to form an antenna terminal ANT. The other end of the reception filter BPF 41 is arranged as a reception terminal RX and the other end of transmission filter BPF 42 is arranged as a transmission terminal TX. In this case, as the reception filter BPF 41 and the transmission filter BPF 42, for example, the high frequency filters shown in FIG. 1 and FIGS. 3 to 7 are used. Since the basic function and performance of the duplexer 40 is publicly known, the explanation of thereof will be omitted.

The duplexer 40 having the above structure incorporates the high frequency filter of the invention, which can achieve miniaturization and can improve attenuation characteristics. Thus, significantly, miniaturization can be achieved and high performance capabilities can be obtained.

The filter device of the invention is not limited to a duplexer and it includes all kinds of filter devices formed by using a single high frequency filter or a plurality of high frequency filters according to the invention. Even in this case, the same advantages as those obtained in the duplexer 40 can be obtained.

Figure 11:
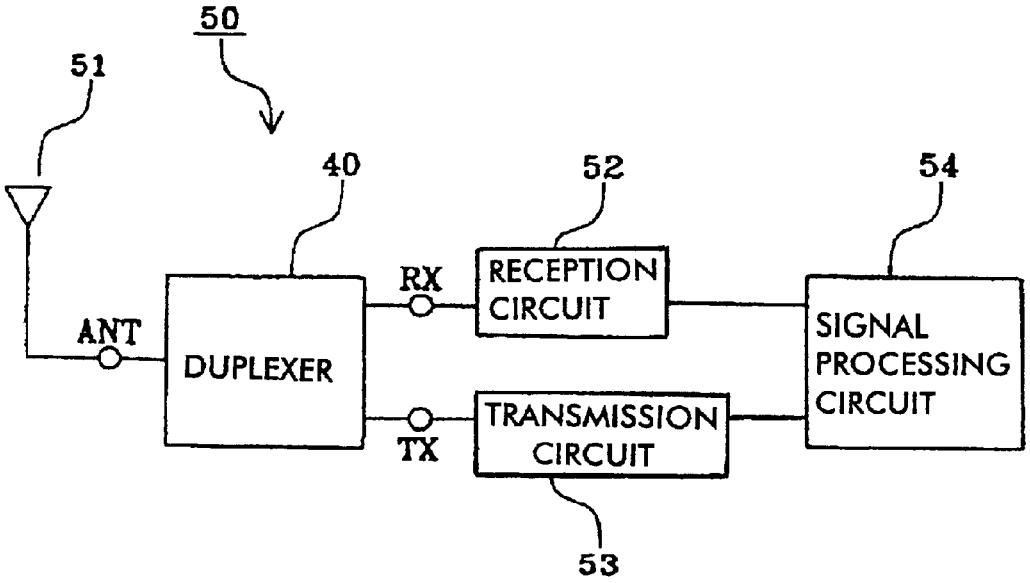
FIG. 11 is a block diagram of an electronic apparatus according to an embodiment of the present invention.

FIG. 11 shows a block diagram of a communication apparatus which is an example of an electronic apparatus according to an embodiment of the invention. In FIG. 11, a communication apparatus 50 includes an antenna 51, the duplexer 40 of the invention shown in FIG. 10, a reception circuit 52, a transmission circuit 53, and a signal processing circuit 54. The antenna 51 is connected to an antenna terminal ANT of the duplexer 40. A reception terminal RX included in the duplexer 40 is connected to the signal processing circuit 54 via the reception circuit 52. The signal processing circuit 54 is connected to a transmission terminal TX included in the duplexer 40 via the transmission circuit 53. The basic function and performance of the communication apparatus 50 is publicly known. Thus, the explanation thereof will be omitted here.

Since the communication apparatus 50 incorporates the duplexer 40 as the filter device of the invention, miniaturization can be achieved and high performance capabilities can be obtained.

The electronic apparatus of the invention is limited neither to a communication apparatus nor to an apparatus including the filter device of the invention. The electronic apparatus of the invention includes all kinds of electronic apparatuses. For example, only the high frequency filter of the invention may be used or both of the high frequency filter and the filter device of the invention may be used. In either case, the same advantages as those obtained in the communication apparatus 50 can be obtained.

Figure 12:
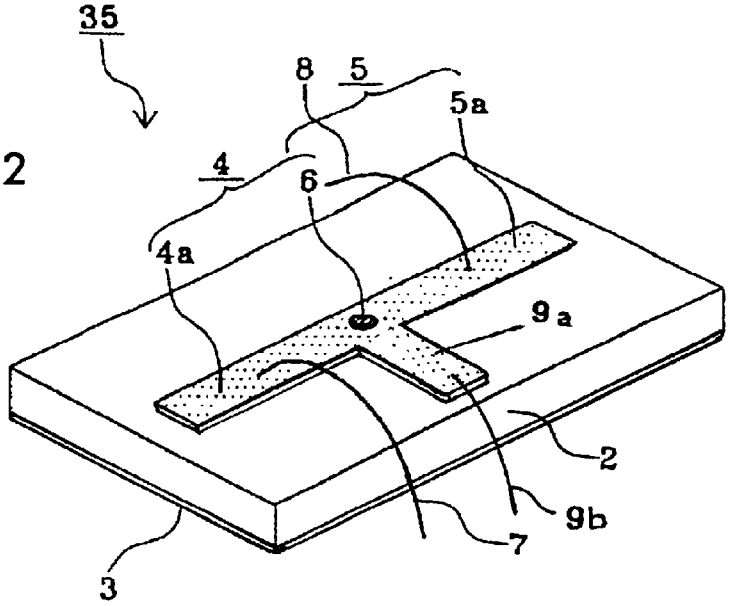
FIGS. 12 and 13 are respectively a perspective view and an equivalent circuit diagram of a further embodiment of the present invention.
Figure 13:
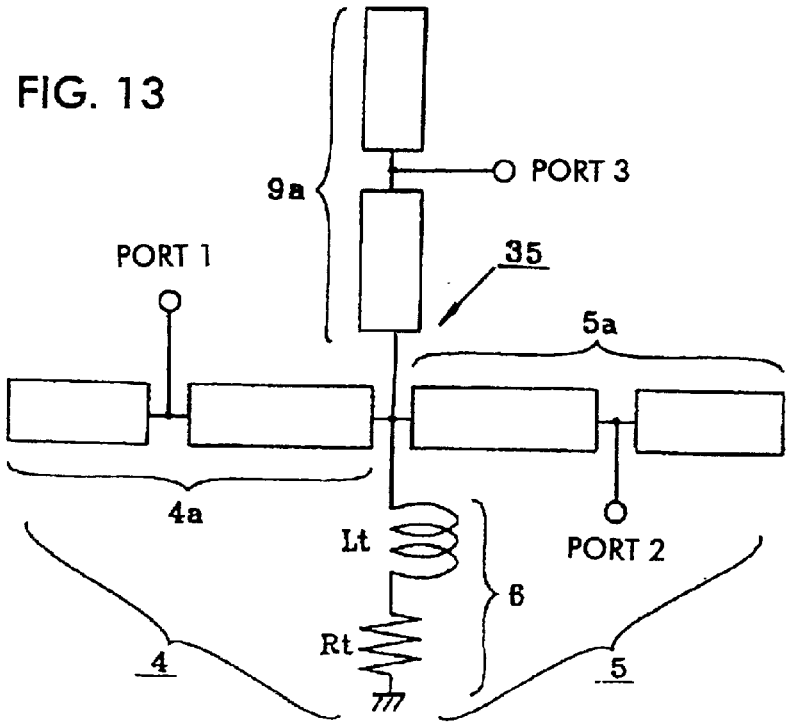

FIGS. 12 and 13 are respectively a perspective view and an equivalent circuit diagram of a further embodiment of the present invention, wherein a filter includes a plurality of microstrip line resonators, namely three resonators in this example.

As described above, in the high frequency filter of the invention, a plurality of microstrip line resonators, in which one end of each line is grounded via a through-hole, shares the through-hole to be mutually coupled via the inductance of the through-hole. As a result, there is no need for an extra element which is used only for coupling the microstrip line resonators, thereby facilitating miniaturization. Furthermore, since the coupling coefficient for coupling between the microstrip line resonators can be made larger, the high frequency filter can obtain a broadband characteristic.

In addition, with the use of the two microstrip line resonators spirally formed in mutually opposing directions, further miniaturization of the high frequency filter can be achieved.

In addition, the side edge of one of the two microstrip line resonators may be arranged close to the side edge of the other microstrip line resonator to be magnetically coupled. With this arrangement, the coupling coefficient is made larger so that the high frequency filter can obtain a broader band characteristic.

In addition, the other end of one of the two microstrip line resonators may be opposed to the side edge of the other microstrip line resonator to be electrically coupled to each other via a capacitance. With this arrangement, excessive magnetic coupling due to miniaturization can be canceled, thereby facilitating further miniaturization of the high frequency filter.

The input/output wire or electrode is connected at a point located between one end and the other end of each microstrip line resonator, to be connected to an outside circuit. With this arrangement, the external Q of the high frequency filter can be easily adjusted.

In the filter device of the invention, by using the high frequency filter according to the invention, miniaturization can be achieved and high performance capabilities can be obtained.

In the electronic apparatus of the invention, by using the high frequency filter or the filter device according to the invention, miniaturization can be achieved and high performance capabilities can be obtained.

While the described embodiments represent the best known mode of practicing the present invention, it is to be understood that modifications will occur to those skilled in the art without departing from the spirit of the invention. The scope of the invention, therefore, is not limited by the disclosed embodiments.

What is claimed is:

1. A high frequency filter comprising:

a dielectric substrate;

a ground electrode arranged on a main surface of the dielectric substrate;

a conductive through-hole; and a plurality of microstrip line resonators formed on the other main surface of the dielectric substrate, one end of each resonator being grounded via the through-hole, wherein the microstrip line resonators share the through-hole for grounding the one end of each resonator to be mutually coupled via the inductance of the through-hole, and wherein an odd-mode resonant frequency is determined by lengths of the plurality of microstrip line resonators and an even-mode resonant frequency is determined by lengths of the plurality of microstrip line resonators and the inductance of the through-hole such that a bandwidth of the filter is adjusted by a value of the inductance of the through-hole.

2. The high frequency filter according to claim 1, further comprising input/output wires connected to respective ones of the microstrip line resonators.

3. A filter device comprising the high frequency filter according to claim 1, and further comprising a pair of terminals for connecting said filter into a circuit.

4. An electronic apparatus incorporating the filter device according to claim 3, and further comprising a high-frequency circuit connected to at least one of said terminals.

5. An electronic apparatus incorporating the high frequency filter according to claim 1, and further comprising a high-frequency circuit connected to said filter.

6. A high frequency filter comprising:

a dielectric substrate;

a ground electrode arranged on a main surface of the dielectric substrate;

a conductive through-hole; and two microstrip line resonators formed on the other main surface of the dielectric substrate, a first end of each resonator being grounded via the through-hole, wherein the two microstrip line resonators share the through-hole for grounding the one end of each resonator to be mutually coupled via the inductance of the through-hole, and wherein an odd-mode resonant frequency is determined by lengths of the two microstrip line resonators and an even-mode resonant frequency is determined by lengths of the two microstrip line resonators and the inductance of the through-hole such that a bandwidth of the filter is adjusted by a value of the inductance of the through-hole.

7. The high frequency filter according to claim 6, wherein the two microstrip line resonators are spirally formed by being wound on said dielectric substrate in mutually opposite directions.

8. The high frequency filter according to claim 7, wherein a side edge of one of the two microstrip line resonators is arranged near a side edge of the other microstrip line resonator to mutually couple the resonators.

9. The high frequency filter according to claim 8, wherein the second end of one of the two microstrip line resonators is opposed to the side edge of the other microstrip line resonator so as to generate a capacitance to mutually couple the resonators.

10. The high frequency filter according to claim 7, wherein the second end of one of the two microstrip line resonators is opposed to the side edge of the other microstrip line resonator so as to generate a capacitance to mutually couple the resonators.

11. The high frequency filter according to claim 6, wherein a side edge of one of the two microstrip line resonators is arranged near a side edge of the other microstrip line resonator to mutually couple the resonators.

12. The high frequency filter according to claim 11, wherein the second end of one of the two microstrip line resonators is opposed to the side edge of the other microstrip line resonator so as to generate a capacitance to mutually couple the resonators.

13. The high frequency filter according to claim 6, wherein the second end of one of the two microstrip line resonators is opposed to the side edge of the other microstrip line resonator so as to generate a capacitance to mutually couple the resonators.

14. The high frequency filter according to claim 6, further comprising input/output wires connected to respective ones of the microstrip line resonators.

15. A filter device comprising the high frequency filter according to claim 6, and further comprising a pair of terminals for connecting said filter into a circuit.

16. An electronic apparatus incorporating the filter device according to claim 15, and further comprising a high-frequency circuit connected to at least one of said terminals.

17. An electronic apparatus incorporating the high frequency filter according to claim 6, and further comprising a high-frequency circuit connected to said filter.

* * * * *